US006971178B2

(12) United States Patent
Rowlay

(10) Patent No.: US 6,971,178 B2
(45) Date of Patent: Dec. 6, 2005

(54) REPLACEABLE BLADE KNIFE

(75) Inventor: Stephen Rowlay, Sheffield (GB)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 10/234,838

(22) Filed: Sep. 5, 2002

(65) Prior Publication Data

US 2004/0045172 A1 Mar. 11, 2004

(51) Int. Cl.[7] ..... B26B 1/08
(52) U.S. Cl. ..... 30/162; 30/125; 30/135; 7/118
(58) Field of Search ..... 30/162, 164, 314, 30/260, 261, 330, 331, 338, 339, 342, 125, 30/335, 340; 7/118, 900

(56) References Cited

U.S. PATENT DOCUMENTS

| | | | | |
|---|---|---|---|---|
| 2,601,450 A | * | 6/1952 | O'Neill | 30/332 |
| 3,332,464 A | * | 7/1967 | Castel | 411/155 |
| 3,509,627 A | | 5/1970 | Gilbert et al. | |
| 3,604,113 A | | 9/1971 | Cuscovitch | |
| 3,611,570 A | * | 10/1971 | Laurenti | 30/268 |
| 3,660,895 A | | 5/1972 | West | |
| 3,803,667 A | * | 4/1974 | Rose | 606/1 |
| 3,845,554 A | | 11/1974 | Joanis et al. | |
| 3,942,249 A | | 3/1976 | Poehlmann | |
| 4,005,525 A | | 2/1977 | Gringer | |
| 4,034,788 A | * | 7/1977 | Melone | 411/134 |
| 4,068,375 A | | 1/1978 | Rathbun et al. | |
| 4,261,104 A | | 4/1981 | Cuscovitch | |
| 4,509,260 A | * | 4/1985 | Gringer | 30/162 |
| 4,524,518 A | * | 6/1985 | West | 30/330 |
| 4,604,805 A | | 8/1986 | Krieger | |
| 4,713,884 A | * | 12/1987 | Dunnagan | 30/294 |
| 4,939,839 A | | 7/1990 | Gorst | |
| 5,005,290 A | | 4/1991 | Gilbert | |
| 5,022,156 A | * | 6/1991 | Kallens et al. | 30/125 |
| 5,301,428 A | | 4/1994 | Wilcox | |
| 5,386,632 A | | 2/1995 | Schmidt | |
| 5,404,645 A | | 4/1995 | Janser | |
| 5,862,596 A | | 1/1999 | Chung | |
| 5,864,952 A | | 2/1999 | Chung | |
| 5,878,501 A | | 3/1999 | Owens et al. | |
| 6,026,575 A | | 2/2000 | Wonderley | |
| 6,163,963 A | | 12/2000 | Huang | |

(Continued)

FOREIGN PATENT DOCUMENTS

EP 1 050 385 A3 12/2000

(Continued)

*Primary Examiner*—Allan N. Shoap
*Assistant Examiner*—Phong Nguyen
(74) *Attorney, Agent, or Firm*—Pillsbury Winthrop Shaw Pittman LLP

(57) ABSTRACT

A utility knife includes a handle assembly comprising first and second handle portions pivotally movable between open and closed positions. A blade carriage within the assembly carries a blade. When the handle portions are in the open position the blade carriage is exposed to enable cutting blade replacement. A threaded fastener mounted on the handle assembly includes a knob portion to enable the fastener to be manually moved between a locking position in which the fastener holds the handle portions in their closed position and a releasing position in which the handle portions can be moved between open and closed positions. A detent assembly is operatively connected to threaded fastener to releasably hold the fastener in its locking position. Movement of the second handle portion into its open position pivots an end portion of the blade carriage outwardly away from the first handle portion to facilitate blade replacement.

23 Claims, 7 Drawing Sheets

U.S. PATENT DOCUMENTS

| | | | | |
|---|---|---|---|---|
| 6,223,439 | B1 * | 5/2001 | Wonderley | 30/162 |
| 6,330,749 | B1 | 12/2001 | Khachatoorian et al. | |

FOREIGN PATENT DOCUMENTS

| | | | |
|---|---|---|---|
| EP | 1 077 117 | A3 | 4/2001 |
| GB | 1 413 679 | | 10/1973 |
| GB | 2 085 799 | A | 5/1982 |
| GB | 2 265 104 | A | 9/1993 |
| WO | WO 88/07918 | A1 | 10/1988 |
| WO | WO 99/00224 | A3 | 1/1999 |

* cited by examiner

REPLACEABLE BLADE KNIFE

FIELD OF THE INVENTION

The present invention relates to hand held cutting tools. More specifically, illustrative embodiments of the present invention relate to replaceable blade knifes.

BACKGROUND

Handheld cutting tools are used in a wide range of activities such as building construction, opening packages and installing carpet. Handheld cutting tools include knives and other cutting implements. The blades of some cutting tools are replaceable to allow a blade to be replaced if it breaks or becomes dull. A utility knife, for example, includes a handle assembly in which a replaceable blade is mounted.

A utility knife handle assembly may include a pair of mating handle portions that are mounted to one another for movement between open and closed positions. In their closed position, the handle portions cooperate to form a gripping surface on an exterior of the handle assembly to enable the handle assembly to be gripped in a hand of a worker during a cutting operation. The cutting blade may be mounted in a blade carriage that is movably mounted within the handle assembly. The blade carriage is operable to carry a blade between extended and retracted positions. To replace an old blade, the handle portions are moved to an open position in which the blade carriage is exposed to enable a cutting blade to be removed from or placed in the blade carriage.

Replacing a blade is time consuming. The handle portions should be easily opened to facilitate blade replacement and yet be securely held in their closed position when the utility knife is in use by a worker performing a cutting operation.

SUMMARY

The present invention can be embodied in a replaceable blade utility knife comprising an elongated utility knife handle assembly comprising first and second handle portions, the second handle portion being movably coupled to the first handle portion for pivotal movement between open and closed positions, the handle portions in their closed position cooperating to provide a gripping surface on an exterior of the handle assembly to enable the handle assembly to be gripped in a hand during a cutting operation and cooperating to form a blade storage compartment at a rearward portion of the handle assembly for storing a supply of spare blades and to form a blade opening and a longitudinal blade passageway communicated to the blade opening at a forward portion of the handle assembly. The utility knife further includes a blade carriage operable to releasably hold a replaceable cutting blade having a cutting edge, the blade carriage being movably mounted within the passageway for movement between a retracted position in which the cutting edge of a cutting blade mounted in the blade carriage is entirely enclosed within an interior portion of the handle assembly and an extended position in which a portion of a length of a cutting blade mounted in the blade carriage extends outwardly through the opening to expose a portion of the cutting edge so that a worker gripping the handle assembly can affect a cutting operation utilizing the cutting blade. The handle assembly is constructed and arranged such that when the second handle portion is in its open position the blade carriage is exposed to enable a cutting blade to be removed from or placed in the blade carriage and the blade storage compartment is open so that one or more blades may be placed therein or removed therefrom. The utility knife further includes a manually engagable structure movably mounted on an exterior portion of the handle assembly and operatively coupled to the blade carriage such that manual movement of the manually engagable structure moves the blade carriage between its retracted and extended positions. The utility knife also includes a manually operable threaded fastener mounted on the handle assembly, the threaded fastener including a manually engageable knob portion mounted on an exterior of the handle assembly to enable the fastener to be manually rotated to move the threaded fastener with respect to the handle assembly between a locking position in which the fastener holds the first and second handle portions in their closed position and a releasing position in which the first and second handle portions can be moved between their open and closed positions. A detent assembly is operatively connected to the threaded fastener, the detent assembly being constructed and arranged to releasably engage the fastener when the fastener is in its locking position to releasably hold the fastener in its locking position and to disengage from the fastener in response to a rotational force manually applied to the knob to allow the fastener to be manually rotated from its locking position toward its releasing position. The blade carriage is mounted on the first handle portion such that movement of the second handle portion into its open position moves the blade carriage angularly outwardly from the first handle portion to facilitate manual movement of a blade into or out of the blade carriage.

The present invention may also be embodied in a replaceable blade utility knife comprising an elongated utility knife handle assembly comprising first and second handle portions, the second handle portion being movably coupled to the first handle portion for pivotal movement between open and closed positions, the handle portions in their closed position cooperating to provide a gripping surface on an exterior of the handle assembly to enable the handle assembly to be gripped in a hand during a cutting operation and cooperating to form a blade storage compartment at a rearward portion of the handle assembly for storing a supply of spare blades and to form a blade opening and a longitudinal blade passageway communicated to the blade opening at a forward portion of the handle assembly. The utility knife also includes a fastener movable into a locking position when the handle portions are in their closed position to hold the handle portions in their closed position and out of the locking position so that the second handle portion can be moved between its closed and open positions. The utility knife further includes a blade carriage operable to releasably hold a replacable cutting blade having a cutting edge, the blade carriage being movably mounted within the passageway for movement between a retracted position in which the cutting edge of a cutting blade mounted in the blade carriage is entirely enclosed within an interior portion of the handle assembly and an extended position in which a portion of a length of a cutting blade mounted in the blade carriage extends outwardly through the opening to expose a portion of the cutting edge so that a worker gripping the handle assembly can affect a cutting operation utilizing the cutting blade. The handle assembly is constructed and arranged such that when the second handle portion is in its open position the blade carriage is exposed to enable a cutting blade to be removed from or placed in the blade carriage and the blade storage compartment is open so that one or more blades may be placed therein or removed therefrom. The utility knife also includes a manually engagable structure movably mounted on an exterior portion of the handle assembly and operatively coupled to the blade carriage such that manual movement of the manually engagable structure moves the blade carriage between its retracted and extended positions. The blade carriage is mounted on the first handle portion such that movement of the second handle portion into its open position moves the blade carriage angularly outwardly from the first handle portion to facilitate manual movement of a blade into or out of the blade carriage.

The present invention may also be embodied in a replaceable blade utility knife comprising an elongated utility knife handle assembly comprising first and second handle portions, the handle portions being mounted to one another for pivotal movement with respect to one another between open and closed positions, the handle portions in their closed position cooperating to provide a gripping surface on an exterior of the handle assembly to enable the handle assembly to be gripped in a hand during a cutting operation and cooperating to form a blade storage compartment at a rearward portion of the handle assembly for storing a supply of spare blades and a blade opening and a longitudinal blade passageway communicated to the blade opening at a forward portion of the handle assembly. The utility knife further includes a blade carriage operable to releasably hold a cutting blade having a cutting edge, the blade carriage being mounted within the passageway for movement between a retracted position in which the cutting edge of a cutting blade mounted in the blade carriage is entirely enclosed within an interior portion of the handle assembly and an extended position in which a portion of the cutting edge of a cutting blade mounted in the blade carriage extends outwardly through the opening so that a worker gripping the handle assembly can affect a cutting operation utilizing the cutting blade. The handle assembly is constructed and arranged such that when the handle portions are in their open position the blade carriage is exposed to enable a cutting blade to be removed from or placed in the blade carriage and the blade storage compartment is open so that one or more blades may be placed therein or removed therefrom. The utility knife also includes a manually engageable structure movably mounted on an exterior portion of the handle assembly and operatively coupled to the blade carriage such that manual movement of the manually engagable structure moves the blade carriage between its retracted and extended positions. A manually operable threaded fastener is mounted on the handle assembly, the threaded fastener including a manually engageable knob portion mounted on an exterior of the handle assembly to enable the fastener to be manually rotated to move the threaded fastener with respect to the handle assembly between a locking position in which the fastener holds the handle portions in their closed position and a releasing position in which the handle portions can be moved between their open and closed positions. A detent assembly is operatively connected to the threaded fastener, the detent assembly being constructed and arranged to releasably engage the fastener when the fastener is in its locking position to releasably hold the fastener in its locking position and to disengage from the fastener in response to a rotational force manually applied to the knob to allow the fastener to be manually rotated from its locking position toward its releasing position.

Other aspects, features, and advantages of the present invention will become apparent from the following detailed description of the illustrated embodiments, the accompanying drawings, and the appended claims.

DETAILED DESCRIPTION OF ILLUSTRATED EMBODIMENTS

Figure 1:
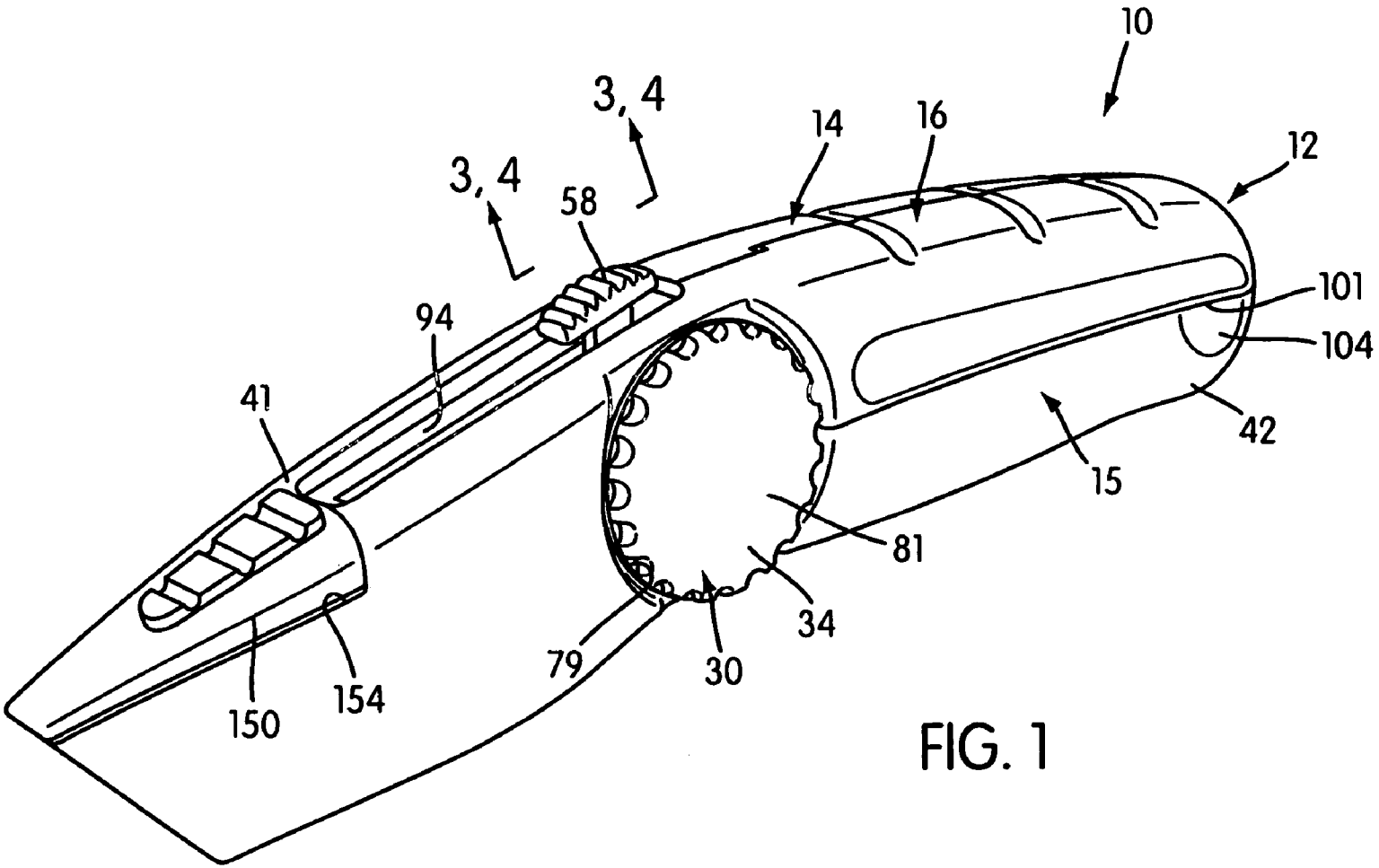
FIG. 1 is a perspective view of a replaceable blade utility knife in accordance with one illustrative embodiment of the present invention.

FIG. 1 shows an illustrative embodiment of a hand held cutting device in the form of a replaceable blade utility knife 10 constructed according to principles of the present invention. The utility knife 10 includes an elongated handle assembly 12 comprising a pair of first and second handle portions 14, 16, respectively. The handle portions 14, 16 are mounted to one another for movement between a closed position (see FIG. 1, for example) and an open position (see FIG. 5, for example). The handle portions 14, 16 in their closed position cooperate to provide a gripping surface 15 on an exterior of the handle assembly 12 to enable the handle assembly 12 to be gripped in a worker's hand during a cutting operation. The handle portions 14, 16 in their closed position also cooperate to form a blade storage compartment 18 at a rearward portion of the handle assembly 12 for storing a supply of spare blades 20 and to form a blade opening 22 and a blade passageway 24 communicated to the blade opening 22 at a forward portion of the handle assembly 12.

A blade carriage 26 is mounted in the longitudinal passageway 24 and is operable to releasably hold a replaceable cutting blade 20 having a cutting edge 28. The blade carriage 26 is movably mounted within the passageway 24 for movement between a retracted position in which the cutting edge 28 of a cutting blade 20 mounted in the blade carriage 26 is enclosed within an interior portion of the handle assembly 12 and an extended position in which a portion of a length of a cutting blade 20 mounted in the blade carriage 26 extends outwardly through the blade opening 22 to expose a portion of the cutting edge 28 so that a worker gripping the handle assembly 12 can affect a cutting operation utilizing the cutting blade 20. When the second handle portion 16 is in its open position with respect to the first handle portion 14 (see FIG. 5, for example), the blade carriage 26 is exposed to enable a cutting blade 20 to be removed from or placed in the blade carriage 26 and the blade storage compartment 18 is open so that one or more replacement blades 20 may be placed therein for storage or removed therefrom.

The blade carriage 26 is mounted on the first handle portion 14 such that movement of the second handle portion 16 into its open position moves the blade carriage 26 angularly outwardly from the first handle portion 14 to facilitate manual movement of a blade into or out of the blade carriage 26. More specifically, movement of the second handle portion 16 into its open position pivots the blade carriage 26 to a blade access position. In its blade access position, an end portion of the blade carriage 26 (e.g., the forward end portion of the blade carriage 26) is positioned outwardly away from the first handle portion 14 so that the blade carriage 26 extends angularly outwardly from the first handle portion 14 to facilitate movement of a cutting blade 20 into or out of the blade carriage 26. In instances in which an old blade is in place in the blade carriage 26, this pivoting action of the blade carriage 26 moves the forward end portion of the old cutting blade 20 upwardly away from the first handle portion 14 so that it is easy to grasp. When placing a new blade in an empty blade carriage 26, the pivoting of the blade carriage 26 enables a worker to more safely, quickly and easily place a new blade in its correct position in the blade carriage 26.

A manually operable threaded fastener 30 is mounted on the handle assembly 12. The threaded fastener 30 includes a manually engageable knob portion 34 mounted on an exterior of the handle assembly 12 to enable the fastener 30 to be manually rotated to move the threaded fastener with respect to the handle assembly 12 between a locking position in which the fastener 30 holds the handle portions 14, 16 in their closed position and a releasing position in which the handle portions 14, 16 can be moved between their open and closed positions (see FIGS. 5, 6 and 9, for example).

A detent assembly 32 is operatively connected to the threaded fastener 30 and is operable to help control and moderate the rotational movement of the fastener 30 and to releasably hold the threaded fastener 30 in an angular position of adjustment. The detent assembly 32 may be constructed and arranged to hold the fastener in an angular position of adjustment and to prevent rotation of the fastener 30 until a manual rotational force of sufficient magnitude (e.g., above a threshold level) is applied to the knob portion 34 so that the fastener 30 remains in its locking position while the utility knife 10 is in use, for example. The detent assembly 32 is operable to releasably engage the fastener 30 when the fastener 30 is in a locking position to releasably hold the fastener in a locking position and to disengage from the fastener 30 in response to a rotational (or angular) force manually applied to the knob portion 34 of the fastener 30 to allow the fastener 30 to be manually rotated from its locking position toward its releasing position. The detent assembly 32 may also releasably hold the fastener 30 in a releasing position and be disengaged from the fastener 30 in response to the application of a rotational force manually applied to the knob portion 34 to allow the fastener 30 to be manually rotated out of its releasing position toward its locking position. The detent assembly 32 may also be constructed to releasably hold the fastener 30 in a plurality of intermediate angular positions (i.e., rotational positions of adjustment) as the threaded fastener 30 is rotated between a locking position and a releasing position.

Figure 2:
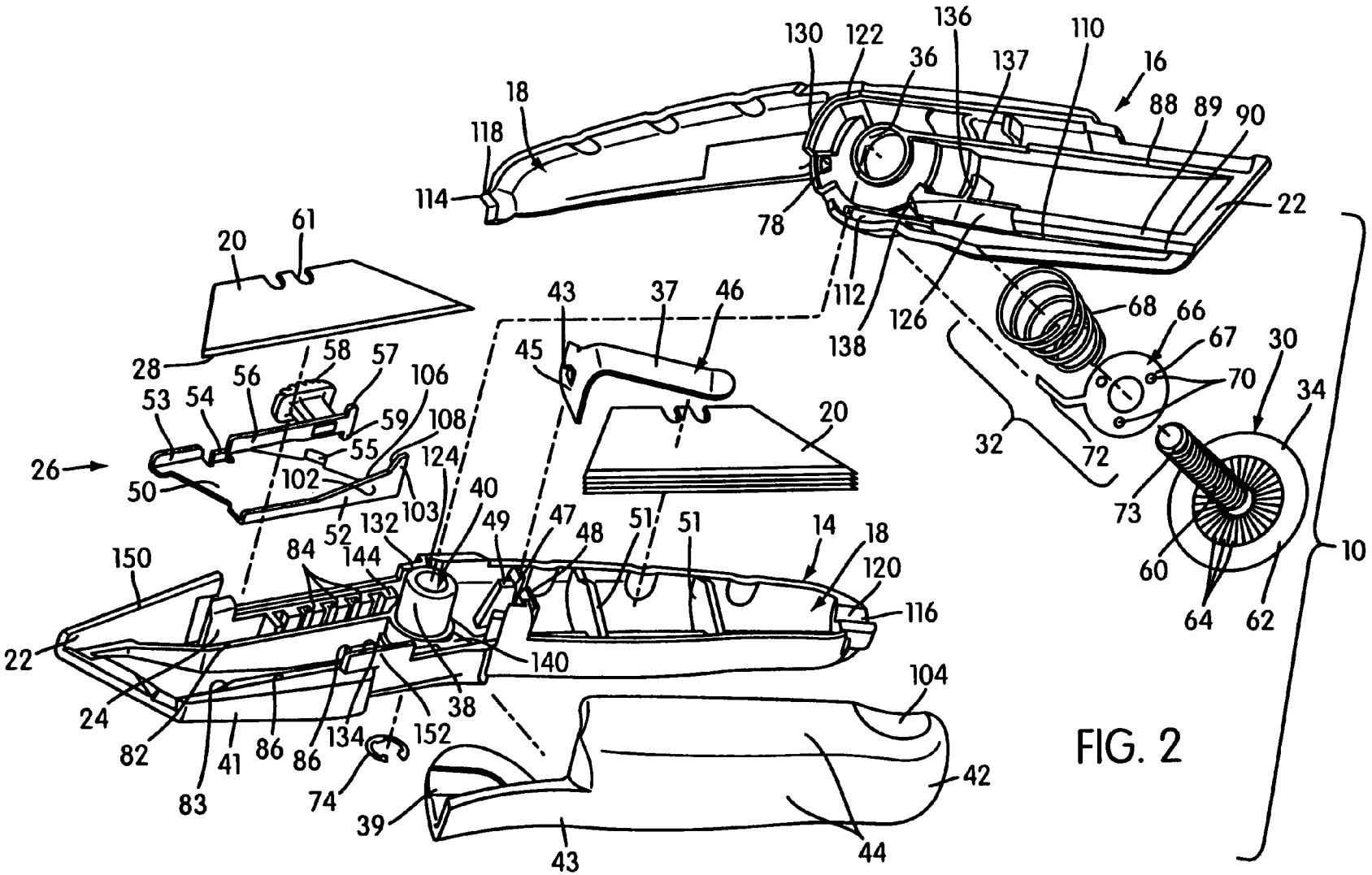
FIG. 2 is an exploded view illustrating the utility knife of FIG. 1 and a plurality of blades.

FIG. 2 shows the components of the utility knife 10 in exploded relation to one another and shows a plurality of cutting blades 20 in exploded relation to the utility knife components. The handle portions 14, 16 comprise a pair of mating structures each of which may be constructed of one or more materials including a metallic material (e.g., aluminum or steel), a plastic (example a molded plastic), a composite material, and/or any other suitable material. The second handle portion 16 includes a central opening 36 and the first handle portion 14 includes a central post structure 38. The post structure 38 has an internally threaded central recess 40.

The first handle portion 14 of the illustrative utility knife 10 is comprised on two structures, an first structure 41 and a grip structure 42 that is mounted on a rearward portion of the first structure 41. The first structure 41 of the first handle portion 14 and the second handle portion 16 may each be one piece integral structures constructed of a metallic material. The grip structure 42 may be constructed of one or more relatively flexible and/or soft materials such as a plastic, a rubber or an elastomeric material to provide a cushioned support structure on the bottom of the utility knife 10 to receive the fingers of a gripping hand during a cutting operation. For example, the grip structure 42 may include an inner layer 39 constructed of a molded plastic of suitable strength to provide the grip structure 42 with sufficient structural strength to support a plurality of gripping fingers of a gripping hand when the utility knife 10 is in use and an outer cover layer 43 constructed of a cushioning material such as a rubber or rubber-like material to cushion the grip structure (see FIG. 2, for example). The grip structure 42 may be shaped to be press-fit onto the first structure 41 of the first handle portion 14 and shaped to provide wall portions 44 (see FIG. 6, for example) which form a portion of the storage compartment 18.

A clip structure 46 may be mounted in the storage compartment 18 to prevent the spare blades 20 stored in the storage compartment 18 from moving within the storage compartment when the handle portions 14, 16 are in their closed position. The illustrative clip structure 46 includes a clip portion 37 and a flange portion 45 extending angularly from one end of the clip portion 37. The clip structure 46 may be an integral structure constructed of a suitable metallic material such as a suitable steel, although any suitable material or materials may be used in its construction. In instances in which the clip structure 46 is an integral structure constructed of a metallic material, the metallic material may be shaped by any suitable method such as, for example, by stamping. The flange 45 may be shaped (e.g., by stamping) to include a projection 43 that is operable to hold the clip structure 46 on the first handle portion 14.

Specifically, in the illustrative embodiment, the clip structure 46 is secured to the first handle portion 14 by inserting the flange 45 on the clip structure 46 between a plurality of walls structures 47, 48, 49. The wall structures 47–49 project outwardly from an inner surface of the first handle portion 14. In instances in which the first handle portion 14 is an integral structure constructed of a metallic material or other suitable material, the wall structures 47–49 may be integrally formed on the inner surface of the first handle portion 14. The projection 43 is shaped and positioned such that when the flange portion 45 of the clip structure 46 is pushed between the wall structures 47, 48 and the wall structure 49, the projection 43 frictionally engages a rearwardly facing wall surface on the wall structure 49 to hold the clip structure 46 on the first handle portion 14 by interference fit.

The clip structure 46 is a spring-like structure that is operable to hold one or more cutting blades 20 in the storage compartment 18 against a plurality of ribs 51 formed on the first handle portion 14. The clip structure 46 thus prevents the cutting blades 20 from rattling or moving within the storage compartment 18 when the utility knife 10 is in use and prevents the cutting blades 20 from accidentally falling out of the storage compartment 18 when the storage compartment 18 is open.

Figure 7:
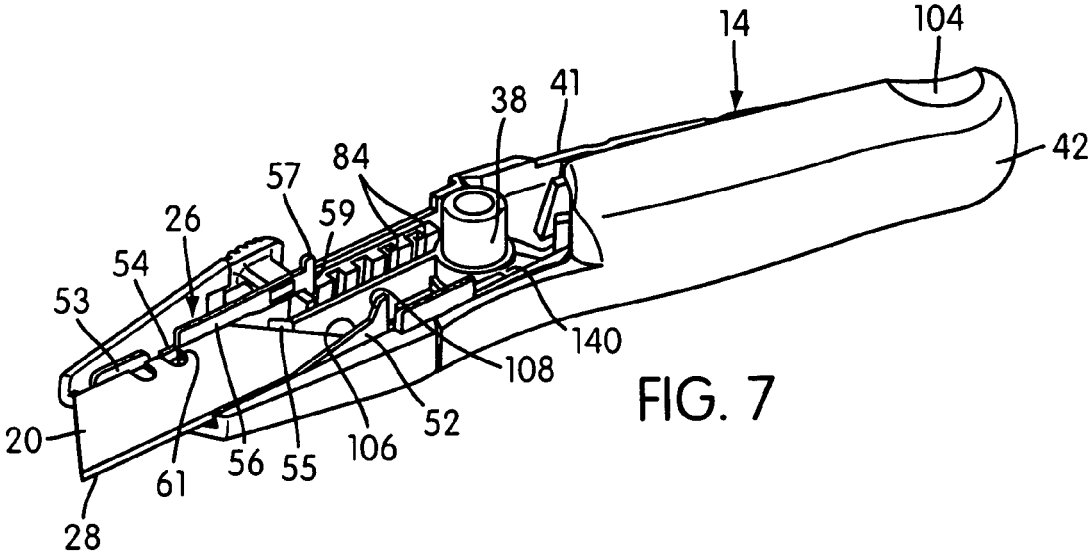
FIGS. 7–9 showing a blade and portions of the utility knife including the blade carriage and the first handle portion in isolation, FIG. 7 showing the blade carriage in an extended position, FIG. 8 showing the blade carriage in a retracted position, and FIG. 9 showing the blade carriage in its blade access position.

The blade carriage 26 may be a one piece integral structure constructed of a metallic material of suitable strength such as a suitable steel. The blade carriage 26 includes a side wall structure 50 and a bottom wall structure 52 extending angularly outwardly from a bottom edge of the side wall structure 50. A plurality of flanges 53, 54, 55 extend angularly outwardly from upper edges of the side wall structure 50 and cooperate with the bottom wall structure 52 to hold the cutting blade 20 on the blade carriage 26. A central flange 54 is disposed within a notch 61 on the cutting blade 20 (see FIGS. 5 and 7, for example) when a blade is mounted in the blade carriage 26. The flange 54 prevents the blade 20 from being pulled out of the blade carriage 26 through the blade opening 22 during a cutting operation, for example.

An integral flexible arm 56 extends rearwardly from the blade carriage 26. A pair of projections 57, 59 extend outwardly from opposite sides of a free end of the flexible arm 56.

A manually engagable structure 58 is mounted on the flexible arm 56 of the blade carriage 26. The manually engagable structure 58 is operatively coupled to the blade carriage 26 and is movably mounted on an exterior portion of the handle assembly 12 such that manual movement of the manually engagable structure 58 moves blade carriage 26 between its retracted and extended positions.

The threaded fastener 30 includes a threaded shaft 60 that extends outwardly from the knob portion 34. A series of recesses 64 are formed on an inner side surface 62 of the knob portion 34. The recesses 64 are circumferentially spaced about the threaded shaft 60.

The detent assembly 32 includes an inner member 66 and a spring structure 68. The inner member 66 may be an integral structure and may be formed of a metallic material of appropriate strength such as an appropriate steel. The inner member 66 may be shaped to have a ring-shaped portion 67 and an arm portion or arm structure 72 that extends from the ring-shaped portion 67. A plurality of detents or projections 70 are formed on the inner member 66.

Figure 3:
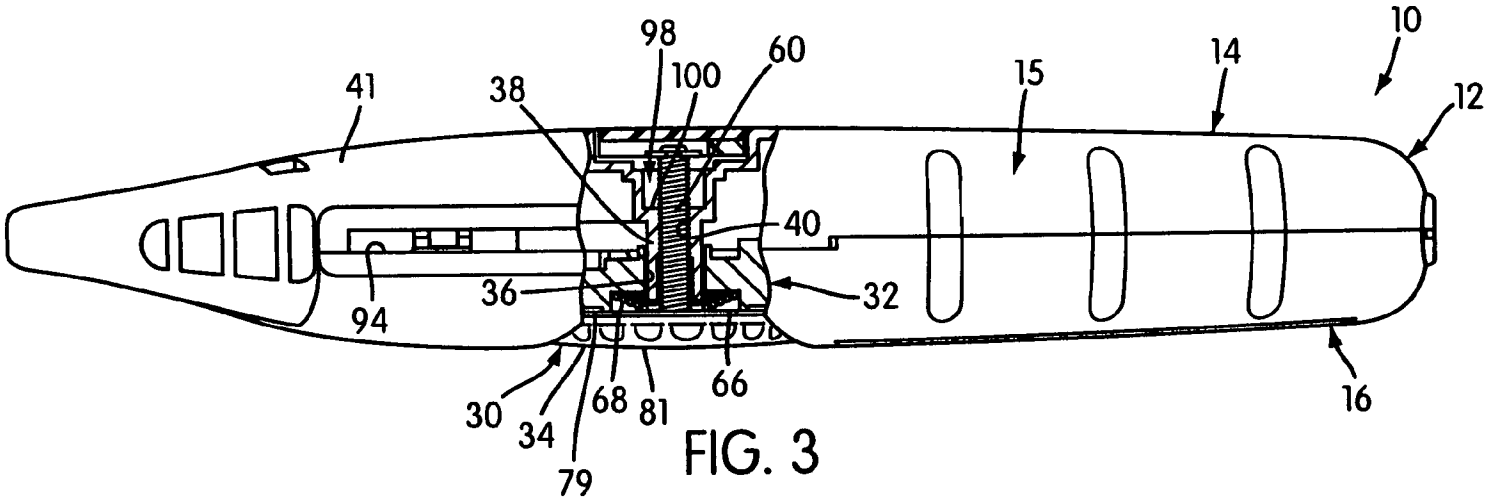
FIG. 3 is a cross-sectional view of a central portion of the utility knife of FIG. 1 taken through the line 3—3 of FIG. 1 illustrating a threaded fastener of the utility knife in a locking position.
Figure 4:
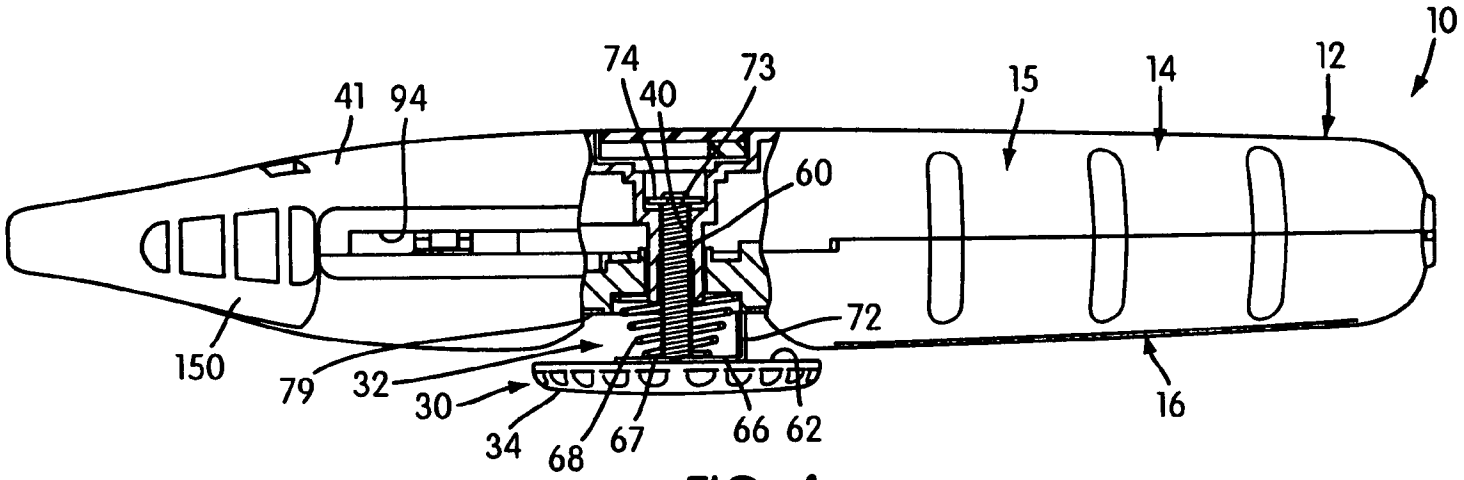
FIG. 4 is a view similar to the view of FIG. 3 except showing the fastener in a releasing position.

FIGS. 3 and 4 illustrate the manner in which the handle portions 14, 16 are mounted to one another in their closed position and the manner in which the threaded fastener 30 and the detent assembly 32 are mounted on the handle portions 14, 16.

When the handle portions 14, 16 are mounted to one another, the post structure 38 on the first handle portion 14 extends through the central opening 36 of the second handle portion 16. The post structure 38 defines a pivot axis for the handle portions 14, 16. The threaded shaft 60 of the threaded fastener 30 extends through an opening 36 in the second handle portion 16 and threadedly engages the internal threads in the threaded recess 40 (see FIGS. 3 and 4, for example) of the first handle portion 14.

A C-shaped retainer structure 74 is mounted within an annular groove 73 formed on the free end of the threaded shaft 60 of the threaded fastener 30. The C-shaped retainer structure 74 is operable to limit the threaded movement of the threaded shaft 60 of the fastener 30 in is releasing direction to prevent the threaded fastener 30 from becoming threadedly disengaged from the internal threads of the first handle portion 14. Specifically, when the threaded fastener 30 is rotated in its releasing direction to the point at which the C-shaped retainer structure 74 abuts against a side surface of the first handle portion 14, the C-shaped retainer structure 74 prevents further rotational movement of the threaded fastener 30 in its releasing direction. The threaded fastener 30 may therefore be permanently attached to the handle assembly 12 for movement between a locking position (see FIG. 3, for example) and a releasing position (see FIG. 4, for example).

The inner member 66 of the detent assembly 32 is mounted between the knob 34 of the threaded fastener 30 and the second handle portion 16. The spring structure 68 is mounted between the inner member 66 and the second handle portion 16. The ring-shaped portion 67 of the inner member 66 is mounted about the shaft 60 of the threaded fastener 30 and the detents 70 on the inner member 66 extend toward the knob portion 34 of the threaded fastener 30 so they can enter the recesses 64 on the knob portion 34. The spring structure 68 biases the inner member 66 against the knob portion 34 of the threaded fastener 30. The detents 70 interengage the recesses 64 on the inner surface of the knob portion 34 and move in and out of the recesses as the knob portion 34 rotates. The knob portion 34 of the threaded fastener 30 and the inner member 66 are therefore connected to one another in a detent relation.

The inner member 66 is mounted on the handle assembly 12 such that as the threaded fastener 30 rotates (i.e., as the knob portion 34 is angularly displaced) with respect to the first and second handle portions 14, 16 in their closed position, the inner member 66 remains in a fixed angular position with respect to the first and second handle portions 14, 16. Specifically, a free end of the arm structure 72 on the inner member 66 is disposed within an opening 78 formed in the second handle portion 16 so that as the threaded fastener 30 is rotated to lock or release the handle portions 14, 16, the ring-shaped portion 67 of the inner member 66 (and, therefore, the projections 70 on the ring-shaped portion 67) does not rotate relative to the knob portion 34. Therefore, as the knob 34 is displaced angularly (i.e., rotated), the detents 70 of the detent assembly 32 move in and out of the recesses 64 on the knob portion 34.

Operation

When the handle portions 14, 16 are in their closed position and the threaded fastener 30 is in its locking position (see FIG. 3, for example), the handle portions 14, 16 are held in their closed position by the threaded engagement of the threaded shaft 60 with the first handle portion 14 and knob portion 34. The knob portion 34 of the threaded fastener 30 is positioned relatively close to the second handle portion 16 when the threaded fastener 30 is in its locking position and is positioned relatively far from the second handle portion 16 when the threaded fastener 30 is in its releasing position.

When the threaded fastener 30 is in its locking position, the knob portion 34 is disposed within a recess 79 formed in the second handle portion 16. The spring structure 68 is in a compressed condition and the spring structure 68 and the inner member 66 are contained within the recess 79 between the knob portion 34 and the side of the second handle portion 16. The spring structure 68 is illustrated as a cone-shaped or frustoconically-shaped coil spring. This cone shapeing of the spring structure 68 allows the spring structure 68 to be made very compact in its compressed configuration because the volutes of the spring structure 68 can be in a partially nested relation to one another (see FIG. 3, for example) An outwardly facing surface 81 on the knob 34 is approximately flush with the adjacent exterior surfaces of the second handle portion 16. The outwardly facing surface 81 therefore forms part of the gripping surface of the handle assembly 12 when the utility knife 10 is in use so the closed handle assembly 12 can be easily gripped during a cutting operation.

Figure 8:
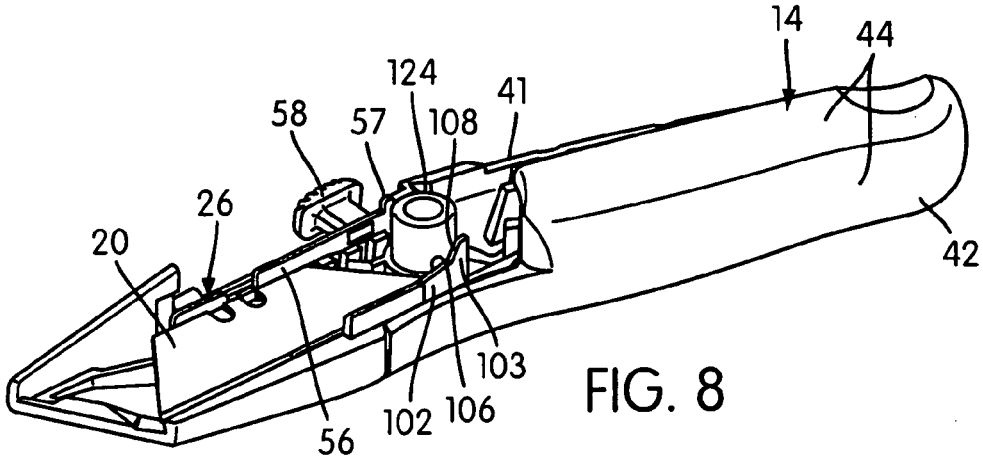

The blade carriage 26 is slidably engaged with the passageway 24 of the handle assembly 12 when the handle portions 14, 16 are in their closed position. The blade carriage 26, the first handle portion 14, the manually engagable structure 58, and a cutting blade 20 are shown in isolation in FIGS. 7–9. The manner in which the blade carriage 26 is engaged with the first handle portion 14 when the handle portions 14, 16 are in their closed position can be appreciated from FIGS. 7 and 8.

Figure 10:
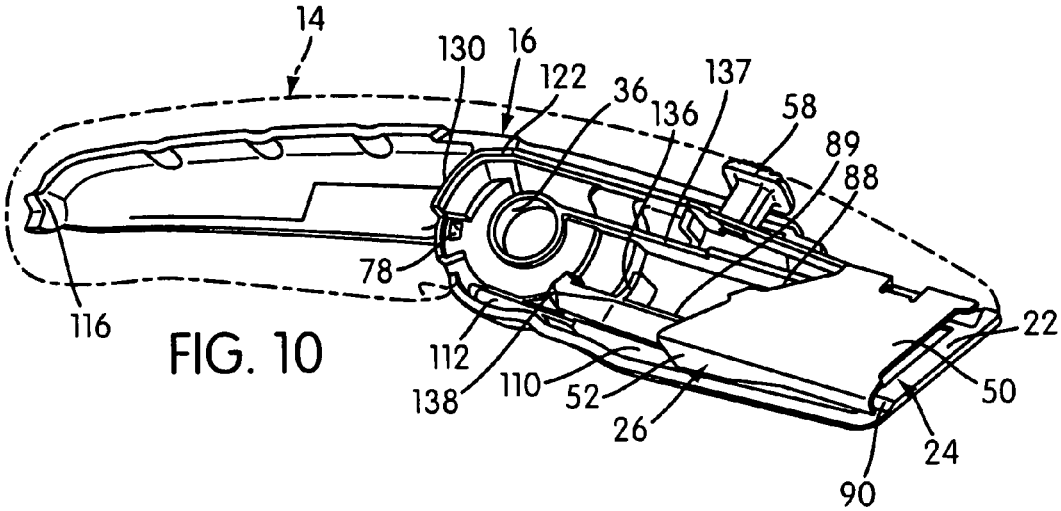
FIGS. 10–12 show the blade carriage and the second handle portion of the utility knife in solid lines in isolation and show an outline of the first handle portion in dashed lines, FIG. 10 showing the second handle portion in its closed position with respect to the first handle portion and the blade carriage in an extended position, FIG. 11 showing a view similar to the view of FIG. 10 except showing the blade carriage in its retracted position and FIG. 12 showing the second handle portion in its open position.
Figure 11:
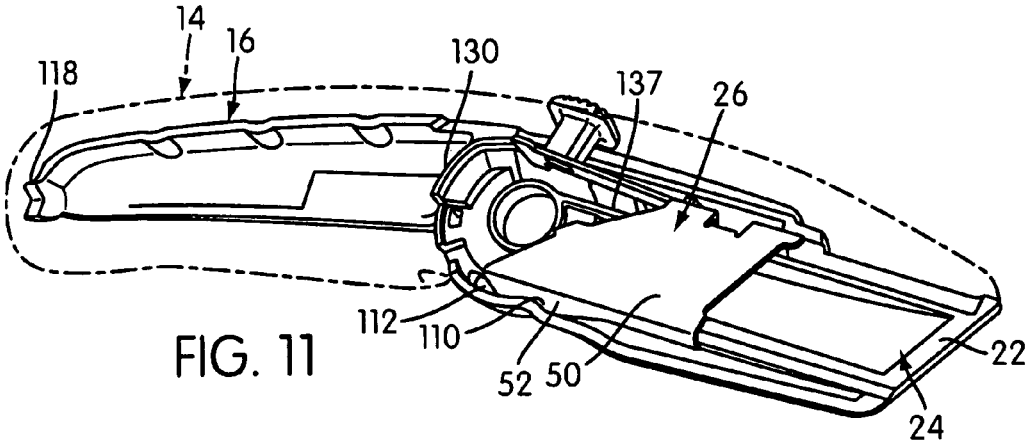
Figure 12:
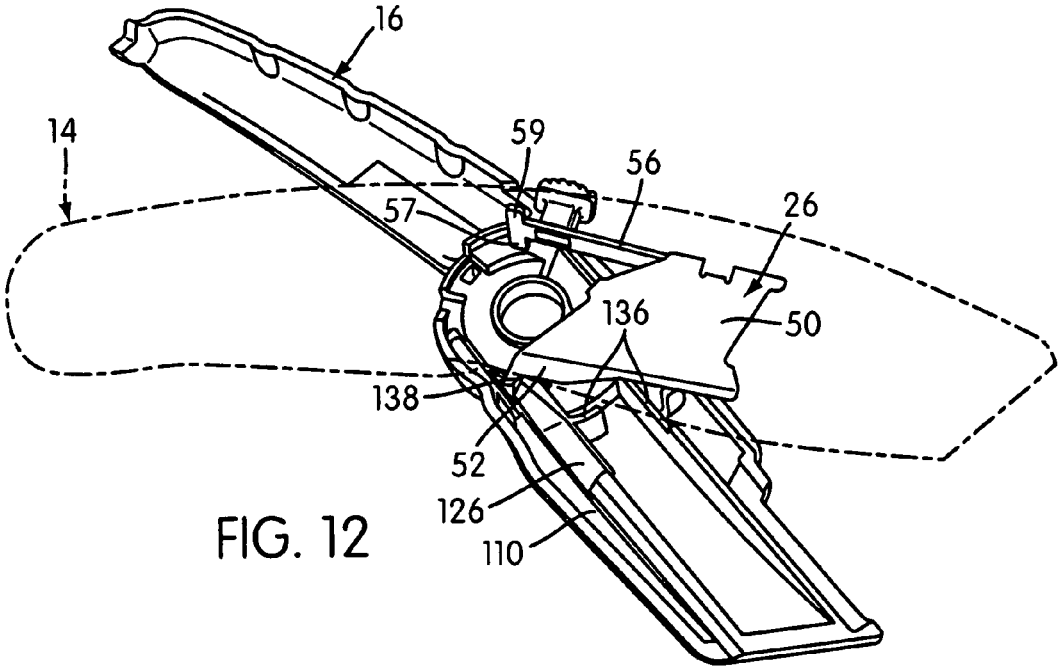

The blade carriage 26, the manually engagable structure 58 and the second handle portion 16 are shown in solid lines in isolation in FIGS. 10–12. The outline of the first handle portion 14 is shown in dashed lines in FIGS. 10–12. The manner in which the blade carriage 26 engages the second handle portion 16 when the handle portions 14, 16 are in their closed position can be appreciated from FIGS. 10 and 11.

When the handle portions 14, 16 are in their closed position, forward end portions of the handle portions 14, 16 cooperate to form the blade passageway 24 and the blade opening 22 (see FIGS. 10 and 11, for example). The blade carriage 26 is supported in the passageway 24 of the closed handle assembly 12 by a plurality of support surfaces 82, 83, 86 on the first handle portion 14 and a plurality of support surfaces 88, 89, 90 on the second handle portion 16 (see FIG. 2, for example). The blade carriage 26 is mounted for slidable movement within the passageway 24 of the closed handle assembly 12 for movement into a retracted position (see FIGS. 8 and 11, for example) or into one or more extended positions (see FIGS. 7 and 10, for example).

The blade carriage 26 is releasably secured in a selected position of adjustment by placing a projection 59 of the flexible arm 56 within a selected recess 84 formed in the first handle portion 14. The recesses 84 are longitudinally spaced so that the blade carriage 26 can be releasably held in its retracted position or in one of its extended positions. To reposition the blade carriage 26 along the passageway 24, the projection 59 is moved out of a recess 84 by bending the flexible arm 56 using the manually engagable structure 58. Specifically, when the handle portions 14, 16 are in their closed position, the manually engagable structure 58 extends out of a longitudinally extending opening 94 formed on the top of the handle assembly 12 by the cooperation of the handle portions 14, 16 (see FIG. 1, for example).

The blade carriage 26 can be repositioned within the passageway 24 by pressing downwardly (e.g., with a thumb of a gripping hand) on the manually engagable structure 58 to flex the flexible arm 56 and thereby move the projection 59 out of one recesses 84 and then sliding the blade carriage 26 forwardly or rearwardly along the passageway 24 by pushing or pulling on the manually engagable structure 58 while holding the flexible arm 56 in its flexed condition. When the blade carriage 26 is in the desired position, the manually engagable structure 58 is released allowing the flexible arm 56 to return to its non-flexed or equilibrium condition. As the flexible arm 56 returns to its equilibrium condition, the projection 59 moves toward the recesses 84. The blade carriage 26 can be moved longitudinally, if required, to align the projection 59 with a desired recess 84. When the projection 59 moves into another one of the recesses 84, the flexible arm 56 holds the blade carriage 26 in a new position of adjustment.

The blade carriage 26 of the illustrative utility knife 10 can be positioned in a retract position (see FIG. 8, for example), in a fully extended or "forward-most" position (see FIG. 7, for example), or in a plurality of intermediate extended positions therebetween. The cutting edge 28 of the cutting blade 20 is within the handle assembly 12 when the blade carriage 26 is in its retracted position. Placing the blade carriage 26 in one of its extended positions causes a portion of the blade to extend out of the blade opening 22. The blade carriage 26 can be moved from one extended position to another of its extended positions to vary the length of the portion of the cutting blade 20 that extends outwardly of the blade opening 22 and thereby vary the length of the exposed cutting edge 28.

To place a blade 20 in or remove a blade 20 from the blade carriage 26, the handle portions 14, 16 are pivoted to their open position. To pivot the handle portions 14, 16 to their open position, the threaded fastener 30 is first moved to a releasing position.

The spring structure 68 biases the inner member 66 against the knob portion 34 of the threaded fastener 30. As the knob portion 34 is rotated in its opening (or releasing) direction, the spring structure 68 biases the inner member 66 against in inner surface of the knob portion 34 of the threaded fastener 30. As the knob portion 34 rotates, the detents 70 move in and out of the recesses 64 on the knob portion 34. In the illustrative utility knife 10, the recesses 64 are provided by an circular array of radially extending grooves, each having a substantially v-shaped cross-section. The sides of each v-shaped slot provide camming surfaces that facilitate the movement of the detents 70 in and out of the recesses 64. In instances in which the inner member 66 is constructed of a metallic material, the inner member 66 may be shaped by stamping. In this instance, each detent 70 may be in the form of a stamped raised area of the sheet metal used to construct the inner member 66. Each detent is sized to fit within a recess 64 in the knob portion 34 of the threaded fastener 30. The detents 70 of the illustrative utility knife 10 are circumferentially spaced about the pivot axis defined by the post structure 38. Three projections 70 are formed on the inner member 66 in the illustrative embodiment, but this is illustrative only and is not intended to be limiting.

The recesses 64 may be spaced to releasably engage the detents 70 at regular angular intervals. In the illustrative embodiment, the recesses 64 are spaced to releasably hold the knob in an angular position of adjustment approximately every eighteen degrees (that is, there are twenty recesses 64 formed in the knob portion 34), but this is an example only. The detent assembly 32 could be constructed to releasably engage the threaded fastener 30 at any desired angular interval. Furthermore, although the detent assembly 32 of the illustrative embodiment is constructed to engage the threaded fastener 30 at regular angular intervals, this is not required by the invention. A detent assembly 32 could be constructed to engage the threaded fastener 30 at irregular angular intervals.

As the knob portion 34 of the threaded fastener 30 moves outwardly from the handle portion, the spring structure 68 expands to hold the inner member 66 in engagement with the knob portion 34. The spring structure 68 also biases the second handle portion 16 against the first handle portion 14. The handle portions 14, 16 may be constructed so that this biasing force exerted by the spring structure 68 holds the handle portions 14, 16 in their closed position until the handle portions 14, 16 are manually separated from one another.

As the threaded fastener 30 is moved toward its retracted position, the C-shaped retainer structure 74 moves into an opening 98 (see FIG. 3, for example) on the first handle portion 14 and toward an outwardly facing surface 100 on the first handle portion 14. If the C-shaped retainer structure 74 contacts the surface 100, the abutting engagement of the C-shaped retainer structure 74 with the surface 100 prevents further movement of the threaded fastener 30 in its opening direction. The C-shaped retainer structure 74 prevents the threaded fastener 30 from becoming disengaged from the handle assembly 12. The grip structure 42 may be constructed so that a portion of the grip structure 42 covers the opening 98 and the free end of the threaded fastener 30 (see FIGS. 3 and 4, for example).

When the knob portion 34 has been moved a sufficient distance outwardly from the second handle portion 16, the second handle portion 16 can be moved into its open position with respect to the first handle portion 14. The detent assembly 32 holds the fastener 30 in its releasing position by preventing the free rotation of the threaded fastener 30. That is, the threaded fastener 30 can only be rotated by affirmatively applying a manual rotational (i.e., angular) force to the knob portion 34 of sufficient magnitude to overcome the releasably locking engagement of the detent assembly 32.

To move the handle portions 14, 16 into their open position, the worker may hold the first handle portion 14 in one hand and apply a manual force to the second handle portion 16. The force may be applied to a rearward portion of the second handle portion 16. A recess 104 may be provided in the grip structure 42 to help the worker engage an edge 101 of the second handle portion 16 with a fingertip. As the second handle portion 16 pivots about the post structure 38 of the first handle portion 14, a plurality of camming surfaces on the handle portions 14, 16 slidingly engage one another to help the handle portions 14, 16 to move outwardly from one another in generally opposite transverse directions and angularly with respect to one another to their pivoted open position. These camming surfaces are considered below.

Figure 6:
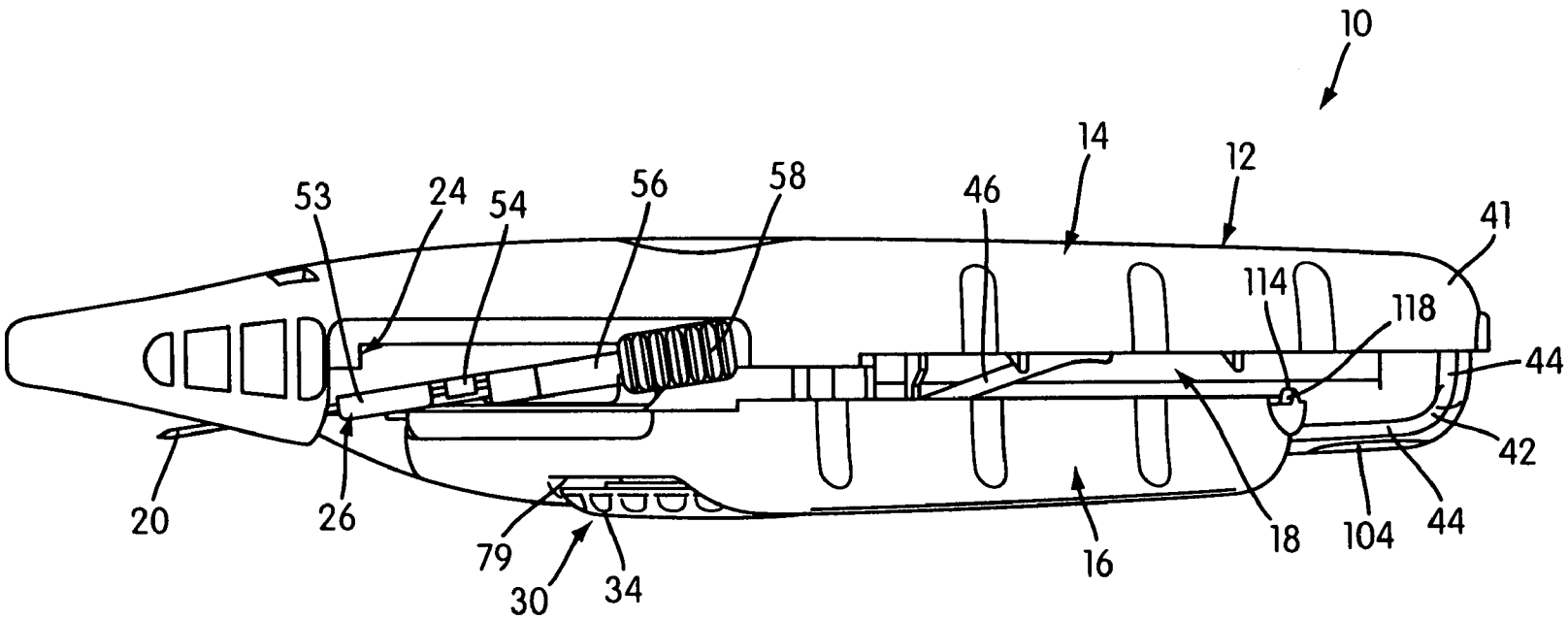
FIG. 6 is a top plan view of the utility knife of FIG. 5.

The first and second handle portions 14, 16 are generally separable from one another along a longitudinally extending parting plane extending between the forward and rearward ends of the handle assembly 12 (see FIGS. 3, 4 and 6, for example). The second handle portion 16 pivots with respect to the first handle portion 14 about a transversely extending pivot axis extending through a central portion of the handle assembly 12. The pivot axis is defined by a cylindrical outer surface of the post structure 38. The shaft 60 of the fastener 30 is co-axial with the pivot axis. When the handle portions 14, 16 move out of their closed position into their open position, the handle portions 14, 16 generally move away from one another in a transverse direction and pivot relative to one another about the pivot axis to their open position.

The illustrative embodiment of a utility knife 10 is constructed such that the handle portions 14, 16 are locked in their closed position until the blade carriage 26 is in its fully retracted position, although this construction and mode of operation are not required by the invention. Specifically, a rearward end portion of the bottom wall structure 52 of the blade carriage 26 is shaped to include a pair of wall sections 102, 103 that define first and second outwardly angled edge portions 106, 108, respectively, of the blade carriage 26 (see FIG. 2, for example). The wall section 103 is the rearwardmost section of the bottom wall structure 52 of the blade carriage 26.

When the handle portions 14, 16 are in their closed position, the wall section 103 of the bottom wall structure 52 of the blade carriage 26 extends into and is disposed within a longitudinally extending slot 110 formed on an inner surface of the second handle portion 16. This construction can be appreciated from FIGS. 7 and 10, for example, which show the blade carriage 26 in its fully extended position on the first and second handle portions 14, 16, respectively. The presence of the wall section 103 in a forward portion of the slot 110 holds the handle portions 14, 16 in their closed position and prevents them from moving into their open position. More specifically, when the blade carriage 26 is in any position forward of its retracted position, the engagement of the wall section 103 with the slot 110 prevents the handle portions 14, 16 from being moved to their open position when the threaded fastener 30 is in its releasing position. When the blade carriage 26 is in its retracted position (see FIGS. 8 and 11, for example), a rearward portion 112 of the slot 110 is shaped to allow the second handle portion 16 to pivot into its open position with respect to the first handle portion 14. It can thus be appreciated that the blade carriage 26 of the illustrative utility knife 10 is moved to its retracted position before the second handle portion 16 pivots from its closed position to it open position.

As mentioned, when the second handle portion 16 moves between its closed and open positions, several camming surfaces on the handle portions 14, 16 and the blade carriage 26 engage one another. Specifically, in the closed position, a generally V-shaped projection 114 on the second handle portion 16 is disposed in a V-shaped recess 116 on the first handle portion 14. The recess-projection connection between the V-shaped projection 114 and the V-shaped recess 116 helps hold the handle portions 14, 16 together in their closed position when the utility knife 10 is used in cutting operations. The V-shaped projection 114 and V-shaped recess 116 also provide camming surfaces that slidingly engage one another as the handle portions 14, 16 are moved out of their closed position. Wall portions 150 and 152 on the first handle portion 14 is disposed within notch 154 and a lower portion of slot 110, respectively, on the second handle portion 16 when the handle portions 14, 16 are in their closed position to help hold the handle portions 14, 16 in their closed position.

Thus, as the second handle portion 16 pivots out of its closed position, a camming surface 118 on the V-shaped projection 114 and a camming surface 120 on the V-shaped projection 114 slidably engage one another and an angled camming surface 122 on the second handle portion 16 slidably engages a camming surface 124 on the second handle portion 16. This camming engagement causes the handle portions 14, 16 to move in opposite transverse directions from one another as they pivot with respect to one another about the pivot axis defined by the post structure 38.

Continued pivotal movement of the second handle portion 16 in its opening direction causes an angled camming surface 126 on the second handle portion 16 to engage an edge of the wall portion 152 on the first handle portion 14. The camming engagement between the camming surface 126 and the wall portion 152 causes the handle portions 14, 16 to move farther apart from one another in opposite transverse directions as the handle portions 14, 16 pivot with respect to one another toward their open position.

As the second handle portion 16 continues to pivot toward its open position, pairs of edges 130, 132 and 134, 136 to move into sliding engagement with one another. The surfaces 130, 132 remain in sliding engagement with one another as the handle portions 14, 16 move into their open position. The surfaces 134, 136 remain in contact for a portion of the opening movement of the second handle portion 16 with respect to the first handle portion 14 and then the surface 134 moves into sliding contact with surface 137 on the second handle portion 16. The surfaces 134, 137 remain in contact as the second handle portion 16 moves into its fully open position.

Figure 5:
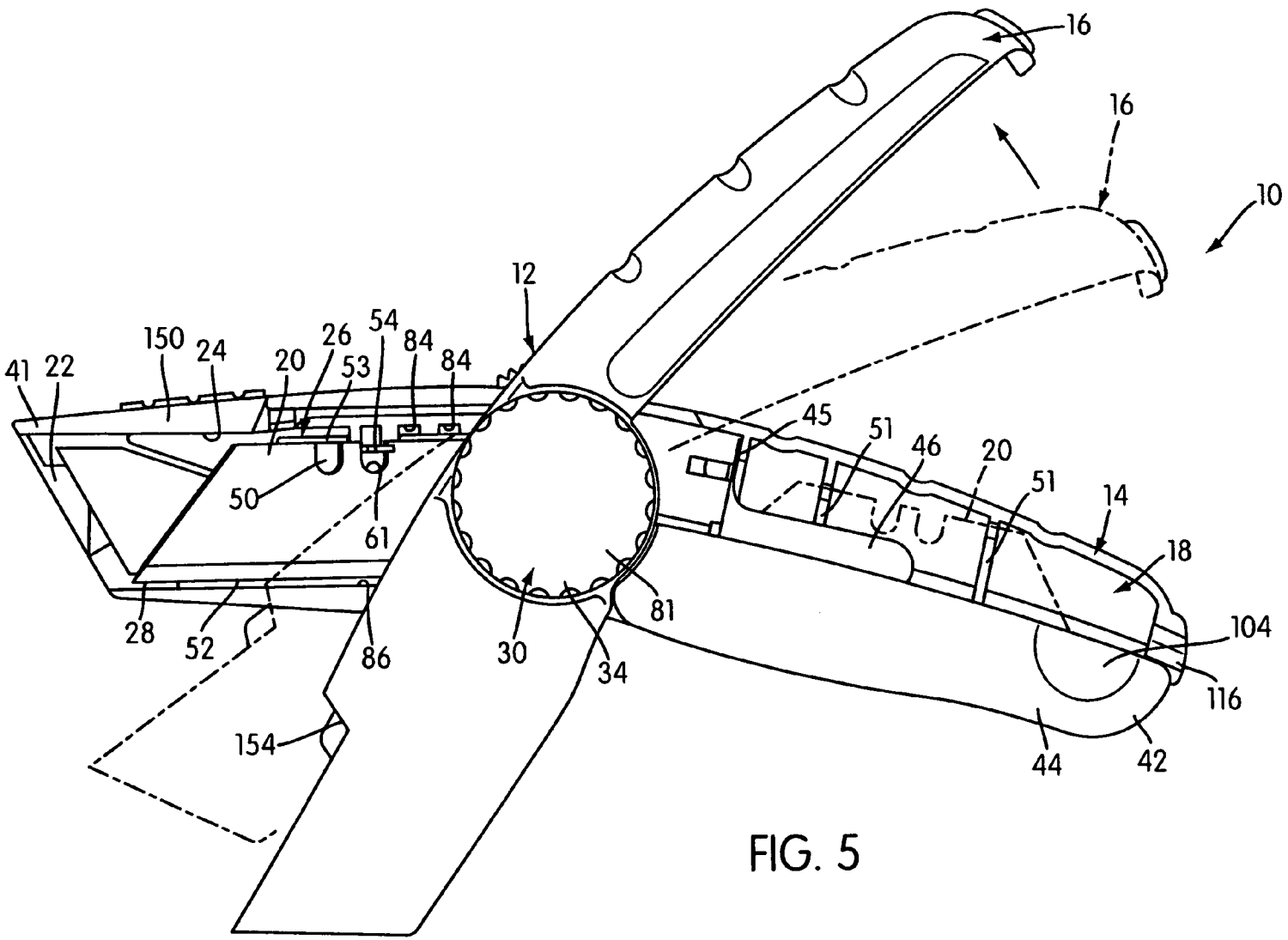
FIG. 5 is a side elevational view of the utility knife of FIG. 1 showing in solid lines a second handle portion of the utility knife in its open position with respect to a first handle portion of the utility knife and showing a blade carriage and a blade carried therein in a blade access position and showing in dashed lines the second handle portion in an intermediate position with respect to the first handle portion.

As the handle portions 14, 16 move toward their open position, an angled surface 138 on the second handle portion 16 engages the angled edge portion 108 on the blade carriage 26. FIG. 5 (broken lines) indicates the approximate position of the second handle portion 16 with respect to the first handle portion 14 when the surfaces 108, 138 contact one another. Continued movement of the second handle portion 16 toward and into its open position causes the forward portion of the blade carriage 26 to pivot outwardly from the first handle portion 14. When the second handle portion 16 moves into its open position, the camming engagement between the camming surfaces 108, 138 pivots the blade carriage 26 against an angled surface 140 on the first handle portion 14 and pivots an end portion of the flexible arm 56 about an edge 144 on the first handle portion 14 (see FIG. 9, for example). The angled surface 140 preferably has approximately the same angular orientation as the side wall structure 50 of the blade carriage 26 in its angled position so that the blade carriage 26 assumes the desired angular orientation when it is pressed against the surface 140.

Figure 9:
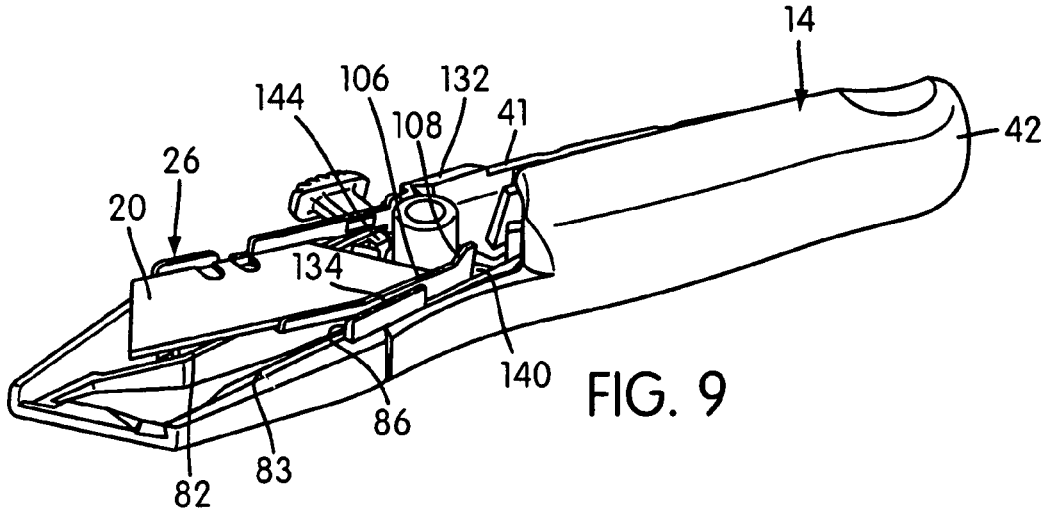

The movement of the second handle portion 16 into its open position thus causes a forward portion of the blade carriage 26 (and the forward end portion of a cutting blade 20 mounted in the blade carriage 26) to pivot outwardly from the first handle portion 14 so that a blade can be easy removed from the blade carriage 26 or placed in the blade carriage 26. FIG. 9 illustrates the orientation of the blade carriage 26 with respect to the first handle portion 14 when the handle portions 14, 16 are in their open position. FIG. 12 illustrates the engagement of the surfaces 138, 108 when the handle portions 14, 16 are in their open position.

After an old blade is removed from the blade carriage 26 and replaced with a new blade, the handle portions 14, 16 can be closed by reversing the steps described above. Movement of the handle portions 14, 16 back to their closed position allows the forward end portion of the blade carriage 26 to pivot back against the first handle portion 14. When the second handle portion 16 moves back into its closed position, the spring structure 68 biases the handle portions 14, 16 against one another to hold the handle assembly 12 in its closed position.

The threaded fastener 30 can be moved to its locking position by rotating the knob portion 34 in its closing direction. Sufficient manual force is applied to the knob portion 34 to overcome the locking engagement between the detent assembly 32 and the knob portion 34. When the knob portion 34 is moved back into its closed position, the detent assembly 32 is operable to hold the knob portion 34 in its locking position.

It can be appreciated that the utility knife 10 illustrated and described herein is illustrative only and not intended to limit the scope of the invention. Variations on the features of the utility knife 10 described and illustrated herein are within the scope of the invention. For example, the illustrative detent assembly 32 is disposed between the knob portion 34 and the body of the utility knife 10. Although this arrangement is preferred and offers numerous advantages, other utility knife constructions are possible. Thus, it can be appreciated that a detent assembly could be incorporated into the utility knife that operatively engages other portions of the threaded fastener 30 other than the knob portion 34. It can also be appreciated that although the blade carriage 26 of the illustrative utility knife 10 is constructed to lock the handle portions in their closed position while the blade carriage 26 is positioned forwardly of its fully retracted position, this is not required by the invention.

Thus, while the invention has been disclosed and described with reference with a limited number of embodiments, it will be apparent that variations and modifications may be made thereto without departure from the spirit and scope of the invention and various other modifications may occur to those skilled in the art. Therefore, the following claims are intended to cover modifications, variations, and equivalents thereof.

What is claimed is:

1. A replaceable blade utility knife, comprising:

an elongated utility knife handle assembly comprising first and second handle portions, the handle portions being movably coupled to one another for pivotal movement between open and closed positions, said handle portions in their closed position cooperating to provide a gripping surface on an exterior of said handle assembly to enable said handle assembly to be gripped in a hand during a cutting operation and cooperating to form a blade storage compartment for storing a supply of spare blades and to form a blade opening and a longitudinal blade passageway communicated to said blade opening at a forward portion of said handle assembly;

a lock member capable of locking the handle portions in their closed position;

a blade carriage operable to releasably hold a replaceable cutting blade having a cutting edge, the blade carriage being movably mounted within said passageway for movement between a retracted position in which the cutting edge of a cutting blade mounted in said blade carriage is entirely enclosed within an interior portion of said handle assembly and an extended position in which a portion of a length of a cutting blade mounted in said blade carriage extends outwardly through said opening to expose a portion of said cutting edge so that a worker gripping the handle assembly can affect a cutting operation utilizing the cutting blade, said handle assembly being constructed and arranged such that when said handle portions are in their open position said blade carriage is exposed to enable a cutting blade to be removed from or placed in said blade carriage and said blade storage compartment is open so that one or more blades may be placed therein or removed therefrom;

manually engagable structure movably mounted on an exterior portion of said handle assembly and operatively coupled to said blade carriage such that manual movement of said manually engagable structure moves said blade carriage between its retracted and extended positions;

said blade carriage being movable angularly outwardly from one of said handle portions when said handle portions are in their open position so as to have at least a portion thereof spaced from said one handle portion to facilitate manual movement of a blade into or out of said blade carriage, wherein said blade carriage moves angularly outwardly from said one handle portion in response to movement of said handle portions into their open position.

2. A replaceable blade utility knife according to claim 1, wherein said lock member comprises a threaded fastener.

3. A replaceable blade utility knife, comprising:

an elongated utility knife handle assembly comprising first and second handle portions, the second handle portion being movably coupled to said first handle portion for pivotal movement between open and closed positions, said handle portions in their closed position cooperating to provide a gripping surface on an exterior of said handle assembly to enable said handle assembly to be gripped in a hand during a cutting operation and cooperating to form a blade storage compartment at a rearward portion of said handle assembly for storing a supply of spare blades and to form a blade opening and a longitudinal blade passageway communicated to said blade opening at a forward portion of said handle assembly;

a blade carriage operable to releasably hold a replaceable cutting blade having a cutting edge, the blade carriage being movably mounted within said passageway for movement between a retracted position in which the cutting edge of a cutting blade mounted in said blade carriage is entirely enclosed within an interior portion of said handle assembly and an extended position in which a portion of a length of a cutting blade mounted in said blade carriage extends outwardly through said opening to expose a portion of said cutting edge so that a worker gripping the handle assembly can affect a cutting operation utilizing the cutting blade, said handle assembly being constructed and arranged such that when said second handle portion is in its open position said blade carriage is exposed to enable a cutting blade to be removed from or placed in said blade carriage and said blade storage compartment is open so that one or more blades may be placed therein or removed therefrom;

manually engagable structure movably mounted on an exterior portion of said handle assembly and operatively coupled to said blade carriage such that manual movement of said manually engagable structure moves said blade carriage between its retracted and extended positions;

a manually operable threaded fastener mounted on said handle assembly, said threaded fastener including a manually engageable knob portion mounted on an exterior of said handle assembly to enable said fastener to be manually rotated to move said threaded fastener with respect to said handle assembly between a locking position in which said fastener holds said first and second handle portions in their closed position and a releasing position in which said first and second handle portions can be moved between their open and closed positions; and a detent assembly operatively connected to said threaded fastener, said detent assembly being constructed and arranged to releasably engage said fastener when said fastener is in its locking position to releasably hold said fastener in its locking position and to disengage from said fastener in response to a rotational force manually applied to said knob to allow said fastener to be manually rotated from its locking position toward its releasing position;

said blade carriage being mounted on said first handle portion such that movement of the second handle portion into its open position moves said blade carriage angularly outwardly from said first handle portion to facilitate manual movement of a blade into or out of said blade carriage.

4. A utility knife according to claim 3, wherein said first and second handle portions are generally separable from one another along a longitudinally extending parting plane extending between forward and rearward ends of said handle assembly, wherein said second handle portion pivots with respect to said first handle portion about a transversely extending pivot axis extending through a central portion of said handle assembly, and wherein said fastener is co-axial with said pivot axis.

5. A utility knife according to claim 4, wherein said threaded fastener extends through an opening in said second handle portion and is threadedly engaged with said first handle portion.

6. A utility knife according to claim 4, wherein said blade carriage is constructed and arranged to lock said handle portions to one another when said blade carriage is positioned forwardly of its releasing position to prevent rotation of the second handle portion with respect to the first handle portion and to allow said second handle portion to pivot between its open and closed positions when said blade carriage is in its retracted position.

7. A utility knife according to claim 6, wherein said handle assembly is constructed and arranged such that said blade carriage can be positioned in one or more intermediate positions between said retracted and extended positions to vary the length of the portion of said blade that extends outwardly of said opening.

8. A utility knife according to claim 3, wherein said knob portion of said fastener is disposed in a recess formed in said second handle portion when said fastener is in its locking position.

9. A utility knife according to claim 3, wherein said fastener is permanently mounted on said handle assembly for movement between said locking position and said releasing position.

10. A utility knife according to claim 3, further comprising a clip structure mounted in the blade storage compartment to prevent spare blades stored therein from moving within said storage compartment when said handle portions are in their closed position.

11. A utility knife according to claim 3, wherein said detent assembly is further constructed and arranged to engage said fastener in its releasing position to releaseably hold said fastener in its releasing position and to disengage from said fastener in response to a rotational force manually applied to said knob to allow said fastener to be manually rotated out of its releasing position toward its locking position.

12. A utility knife according to claim 11, wherein said detent assembly is constructed and arranged to releasably hold said fastener in a plurality of intermediate angular positions as said threaded fastener is rotated between its locking and releasing positions.

13. A utility knife according to claim 12, said detent assembly comprising an inner member mounted between said knob and said second handle portion and a spring structure mounted between said inner member and said second handle portion, said inner member and said knob being constructed and arranged to be connected in detent relation with one another and said spring structure being operable to bias said inner member against said knob as said threaded fastener rotates and moves between its locking and releasing positions, said inner member being mounted on said handle assembly such that as said threaded fastener rotates with respect to said first and second handle portions in their closed position, said inner member remains in a fixed angular position with respect to said first and second handle portions.

14. A utility knife according to claim 13, wherein said knob portion of said fastener and said detent assembly are disposed in a recess formed in said second handle portion when said fastener is in its locking position.

15. A replaceable blade utility knife, comprising:

an elongated utility knife handle assembly comprising first and second handle portions, the second handle portion being movably coupled to said first handle portion for pivotal movement between open and closed positions with respect thereto, said handle portions in their closed position cooperating to provide a gripping surface on an exterior of said handle assembly to enable said handle assembly to be gripped in a hand during a cutting operation and cooperating to form a blade storage compartment at a rearward portion of said handle assembly for storing a supply of spare blades and to form a blade opening and a longitudinal blade passageway communicated to said blade opening at a forward portion of said handle assembly;

a lock member movable into a locking position when the handle portions are in their closed position to hold said handle portions in their closed position and out of said locking position so that said second handle portion can be moved between its closed and open positions;

a blade carriage operable to releasably hold a replaceable cutting blade having a cutting edge, the blade carriage being movably mounted within said passageway for movement between a retracted position in which the cutting edge of a cutting blade mounted in said blade carriage is entirely enclosed within an interior portion of said handle assembly and an extended position in which a portion of a length of a cutting blade mounted in said blade carriage extends outwardly through said opening to expose a portion of said cutting edge so that a worker gripping the handle assembly can affect a cutting operation utilizing the cutting blade, said handle assembly being constructed and arranged such that when said second handle portion is in its open position said blade carriage is exposed to enable a cutting blade to be removed from or placed in said blade carriage and said blade storage compartment is open so that one or more blades may be placed therein or removed therefrom;

manually engagable structure movably mounted on an exterior portion of said handle assembly and operatively coupled to said blade carriage such that manual movement of said manually engagable structure moves said blade carriage between its retracted and extended positions;

said blade carriage being mounted on said first handle portion such that movement of the second handle portion into its open position moves said blade carriage angularly outwardly from said first handle portion to facilitate manual movement of a blade into or out of said blade carriage.

16. A utility knife according to claim 15, wherein said first and second handle portions are generally separable from one another along a parting plane extending between forward and rearward ends of said handle assembly, wherein said second handle portion pivots with respect to said first handle portion about a transversely extending pivot axis extending through a central portion of said handle assembly, and wherein said fastener is co-axial with said pivot axis.

17. A utility knife according to claim 15, wherein said blade carriage is constructed and arranged to lock said handle portions to one another when said blade carriage is positioned forwardly of its releasing position to prevent rotation of the second handle portion with respect to the first handle portion and to allow said second handle portion to pivot between its open and closed positions when said blade carriage is in its retracted position.

18. A utility knife according to claim 17, wherein said handle assembly is constructed and arranged such that said blade carriage can be positioned in one or more intermediate positions between said retracted and extended positions to vary the length of the portion of said blade that extends outwardly of said opening.

19. A utility knife according to claim 15, wherein said lock member comprises a threaded fastener.

20. A utility knife according to claim 19, wherein said fastener includes a manually engagable knob at one end thereof constructed and arranged to be gripped by a hand so that said fastener can be moved between its open and closed positions by rotating said knob with a hand.

21. A utility knife according to claim 20, wherein said fastener is permanently mounted on said handle assembly for movement between said locking position and a releasing position in which said second handle portion can be moved between its closed and open positions.

22. A utility knife according to claim 15, further comprising a clip structure mounted in the blade storage compartment to prevent spare blades stored therein from moving within said storage compartment when said handle portions are in their closed position.

23. A replaceable blade utility knife, comprising:

an elongated utility knife handle assembly comprising first and second handle portions, said handle portions being mounted to one another for pivotal movement with respect to one another between open and closed positions, the handle portions in their closed position cooperating to provide a gripping surface on an exterior of said handle assembly to enable said handle assembly to be gripped in a hand during a cutting operation and cooperating to form a blade storage compartment at a rearward portion of said handle assembly for storing a supply of spare blades and a blade opening and a longitudinal blade passageway communicated to said blade opening at a forward portion of said handle assembly;

a blade carriage operable to releasably hold a cutting blade having a cutting edge, the blade carriage being mounted within said passageway for movement between a retracted position in which the cutting edge of a cutting blade mounted in said blade carriage is entirely enclosed within an interior portion of said handle assembly and an extended position in which a portion of the cutting edge of a cutting blade mounted in said blade carriage extends outwardly through said opening so that a worker gripping the handle assembly can affect a cutting operation utilizing the cutting blade, said handle assembly being constructed and arranged such that when said handle portions are in their open position said blade carriage is exposed to enable a cutting blade to be removed from or placed in said blade carriage and said blade storage compartment is open so that one or more blades may be placed therein or removed therefrom;

manually engageable structure movably mounted on an exterior portion of said handle assembly and operatively coupled to said blade carriage such that manual movement of said manually engagable structure moves said blade carriage between its retracted and extended positions;

a manually operable threaded fastener mounted on said handle assembly, said threaded fastener including a manually engageable knob portion mounted on an exterior of said handle assembly to enable said fastener to be manually rotated to move said threaded fastener with respect to said handle assembly between a locking position in which said fastener holds said handle portions in their closed position and a releasing position in which said handle portions can be moved between their open and closed positions; and a detent assembly operatively connected to said threaded fastener, said detent assembly being constructed and arranged to releasably engage said fastener when said fastener is in its locking position to releasably hold said fastener in its locking position and to disengage from said fastener in response to a rotational force manually applied to said knob to allow said fastener to be manually rotated from its locking position toward its releasing position, wherein said detent assembly is further constructed and arranged to engage said fastener in its releasing position to releaseably hold said fastener in its releasing position and to disengage from said fastener in response to a rotational force manually applied to said knob to allow said fastener to be manually rotated out of its releasing position toward its locking position, wherein said detent assembly is constructed and arranged to releasably hold said fastener in a plurality of intermediate angular positions as said threaded fastener is rotated between its locking and releasing positions, wherein said first and second handle portions are generally separable from one another along a parting plane extending between forward and rearward ends of said handle assembly, wherein said handle portions pivot with respect to one another about a transversely extending pivot axis extending through a central portion of said handle assembly, and wherein said threaded fastener is co-axial with said pivot axis, wherein said threaded fastener extends through an opening in said second handle portion and is threadedly engaged with said first handle portion, and wherein said threaded fastener is permanently attached to said first handle portion, said detent assembly comprising an inner member mounted between said knob and said second handle portion and a spring structure mounted between said inner member and said second handle portion, said inner member and said knob being constructed and arranged to be connected in detent relation with one another and said spring structure being operable to bias said inner member against said knob as said threaded fastener rotates and moves between its locking and releasing positions, said inner member being mounted on said handle assembly such that as said threaded fastener rotates with respect to said first and second handle portions in their closed position, said inner member remains in a fixed angular position with respect to said first and second handle portions.

* * * * *